US009789375B2

(12) United States Patent
Salerno

(10) Patent No.: US 9,789,375 B2
(45) Date of Patent: Oct. 17, 2017

(54) TRAINING APPARATUS INCLUDING A MANNEQUIN

(76) Inventor: John Salerno, London (GB)

( * ) Notice: Subject to any disclaimer, the term of this patent is extended or adjusted under 35 U.S.C. 154(b) by 0 days.

(21) Appl. No.: 14/122,174

(22) PCT Filed: Apr. 5, 2012

(86) PCT No.: PCT/IB2012/051714

§ 371 (c)(1),
(2), (4) Date: Feb. 19, 2014

(87) PCT Pub. No.: WO2012/140555

PCT Pub. Date: Oct. 18, 2012

(65) Prior Publication Data

US 2014/0155228 A1 Jun. 5, 2014

(30) Foreign Application Priority Data

Apr. 14, 2011 (GB) ..... 1106386.4

(51) Int. Cl.
*A63B 69/34* (2006.01)
*A63B 69/00* (2006.01)
(Continued)

(52) U.S. Cl.
CPC ..... *A63B 69/004* (2013.01); *A63B 69/201* (2013.01); *A63B 69/203* (2013.01);
(Continued)

(58) Field of Classification Search
CPC ..... A47F 8/02; A63B 69/004; A63B 69/34
See application file for complete search history.

(56) References Cited

U.S. PATENT DOCUMENTS 164,582 A * 6/1875 Miller ..... A63H 3/04 446/373
3,888,481 A 6/1975 Adams
(Continued)

FOREIGN PATENT DOCUMENTS

GB 2489986 A 10/2012
WO 2012/140555 A1 10/2012

OTHER PUBLICATIONS http://www.merriam-webster.com/dictionary/resilient, last visited Sep. 21, 2016.*
UKIPO Search Report, dated Jun. 30, 2011.

*Primary Examiner* — Sundhara Ganesan
*Assistant Examiner* — Rae Fischer
(74) *Attorney, Agent, or Firm* — Crose Law LLC; Bradley D. Crose

(57) ABSTRACT

A training apparatus 2 including a mannequin 4, for being struck by a person training for fighting, the apparatus comprising a support structure 6 for supporting the mannequin, the mannequin including a head 16, a torso, two arms 76 (having upper and lower arms) and two legs 10, and having joints at the shoulders 50, hips 56, knees 54 and elbows 52, wherein the joints at the shoulders are configured to variably adjust and fix the position of the upper arms relative to the torso in at least two orthogonal planes, and the joints at the elbows are configured to variably adjust and fix the position of the lower arms relative to the upper arms in at least one plane, the apparatus including ankle attachment means for removably attaching the ankles to the support structure.

19 Claims, 14 Drawing Sheets

(51) Int. Cl.
*A63B 69/20* (2006.01)
*A63B 71/02* (2006.01)

(52) U.S. Cl.
CPC ..... *A63B 69/34* (2013.01); *A63B 71/023* (2013.01); *A63B 69/206* (2013.01); *A63B 2071/026* (2013.01); *A63B 2210/50* (2013.01); *A63B 2225/09* (2013.01); *A63B 2225/093* (2013.01)

(56) References Cited

U.S. PATENT DOCUMENTS

| | | | | | |
|---|---|---|---|---|---|
| 4,088,315 | A * | 5/1978 | Schemmel | A63B 69/34 | 482/4 |
| 4,702,472 | A | 10/1987 | Anquetil | | |
| 5,152,733 | A | 10/1992 | Farenholtz | | |
| 5,665,035 | A * | 9/1997 | Tumminia | A63B 21/0552 | 482/83 |
| 6,155,960 | A * | 12/2000 | Roberts | A63B 69/34 | 482/83 |
| 2013/0186922 | A1* | 7/2013 | Soto Velasco | A47F 8/00 | 223/66 |

* cited by examiner

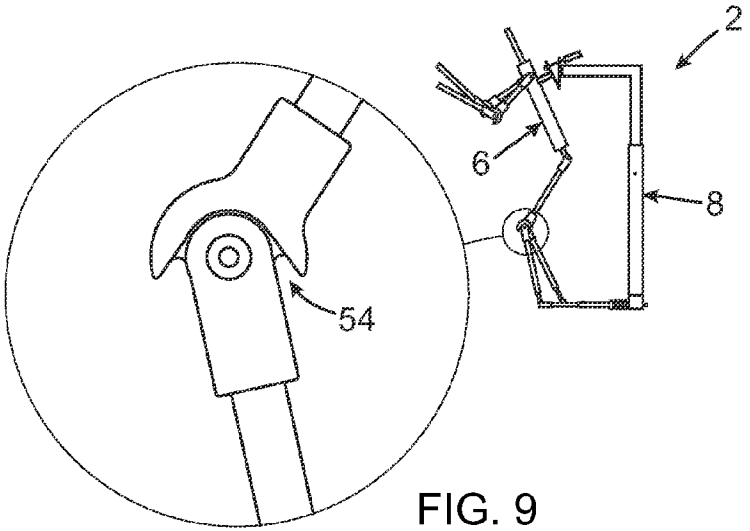
FIG. 9
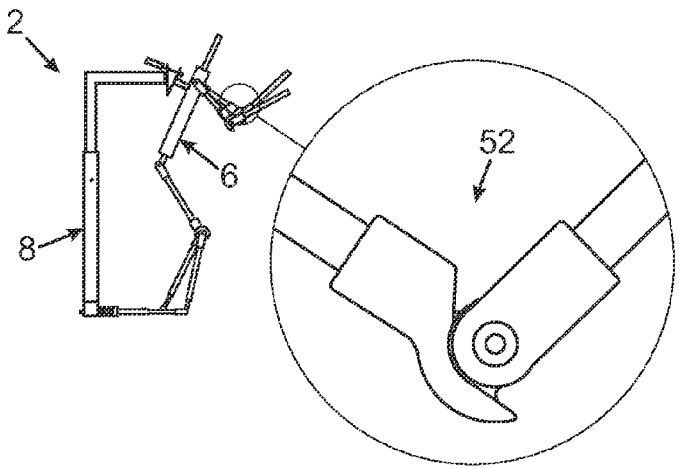
FIG. 7
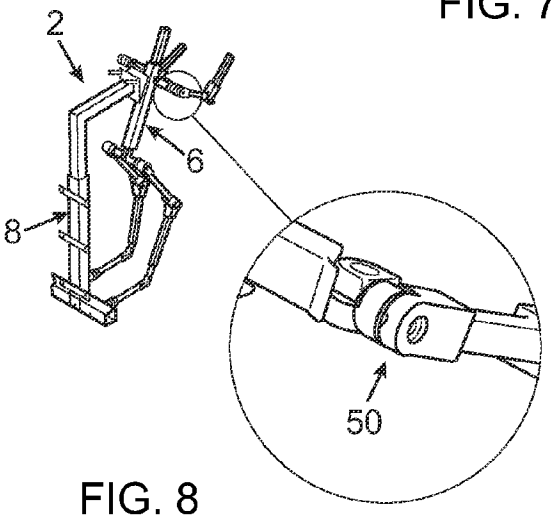
FIG. 8
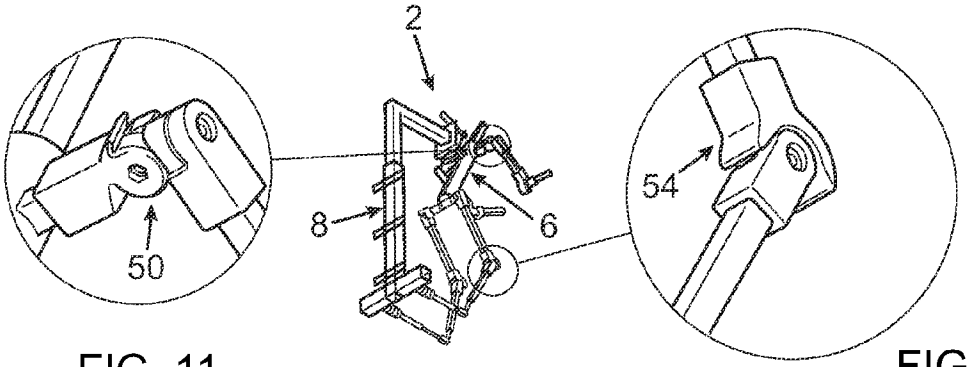
FIG. 10
FIG. 11

TRAINING APPARATUS INCLUDING A MANNEQUIN

The present invention relates generally to a training apparatus including a mannequin, for being struck by a person training for fighting, and finds particular, although not exclusive, utility in training for boxing, kick-boxing, and other martial arts that have hand, foot or weapon contact.

There are various types of known apparatus for being struck by a person training for fighting. For example, a person training for boxing may use apparatus comprising a boxing bag. A person training for sports involving kicking, for example kick-boxing or material arts, may employ apparatus comprising a kick bag. A person training for material arts or sports involving hand, foot or weapon contact may employ apparatus comprising a rigid post or other strikeable object. The weapon may be a stock. Often the known apparatus is suitable for one type of sport but not another type of sport. Often the apparatus is not realistic. Often the apparatus is not sufficiently robust.

It is an aim of the present invention to reduce the above mentioned problems and to provide improved apparatus.

Accordingly, in one aspect of the invention, there is provided a training apparatus including a mannequin, for being struck by a person training for fighting, the apparatus comprising a support structure for supporting the mannequin, the mannequin including a head, a torso, two arms (having upper and lower arms) and two legs, and having joints at the shoulders, hips, knees and elbows, wherein the joints at the shoulders are configured to variably adjust and fix the position of the upper arms relative to the torso in at least two orthogonal planes, and the joints at the elbows are configured to variably adjust and fix the position of the lower arms relative to the upper arms in at least one plane, the apparatus including ankle attachment means for removably attaching the ankles to the support structure.

Any of the joints may include releasable tightening members for varying the tightness of the joints. In other words, the shoulder joints may include these members such that the force required to move the upper arm relative to the torso is adjustable. This may also apply to any other joint such as the hip joints, the elbow joints, the knee joints and ankle joints.

The apparatus is able to be realistic because it employs the mannequin. The apparatus is suitable for persons training for a wide variety of types of fighting because the mannequin is able to be struck with a person's hand, foot or weapon. The apparatus is able to be used by persons of different heights and postures. Thus the apparatus is able to be used by short, medium or tall persons, and by persons with an orthodox fighting style or a non-orthodox fighting style such for example as a southpaw (left-handed) fighting style in boxing.

The legs may comprise, upper and lower legs articulated at the knee.

The joints at the hips may be configured to variably adjust and fix the position of the upper legs relative to the torso.

The joints at the knees may also be configured to variably adjust and fix the position of the lower legs relative to the upper legs. The knee joints may include rotation limiters to prevent the angle behind the knees, between the upper and lower legs, being greater than or equal to 180 degrees. This prevents the legs from becoming locked in a straight position, and/or the legs being bent backwards. This may occur after having had a force imparted to the knees, such as by the knees being kicked. It may also occur if the torso is pulled forwardly and downwardly for the application of upper cut thrusts and or knee-strikes to the head) as the in doing this the hips lift upwardly straightening the legs. Once the torso is released the legs can remain locked in this straight position. The rotation limiters may prevent this from occurring.

Any one or more of the joints may comprise two parts held together by a bolt, each part rotatable relative to the other part about the long axis of the bolt, the bolt including a nut, the tightening of the nut tightening the joint so that the ease with which the two parts rotate relative to one another is decreased, and the loosening of the nut loosening the joint so that the ease with which the two parts rotate relative to one another is increased. In this way, each joint may be adjusted and set as required such that the posture and position of each limb relative to each other and to the torso may be chosen. Also, the force required to overcome the setting may be set in this way as these joints use varying degrees of friction to hold themselves in place.

Other types of joints are contemplated such as constant friction joints in which the amount of force required to move one limb relative to another limb or torso is pre-set.

The training apparatus may include a mannequin attachment mechanism for removably attaching the mannequin to the support structure, wherein the attachment mechanism may also include adjustment means for variably adjusting and fixing the position of the torso relative to the support structure. For instance, the angle of the torso relative to the vertical may be adjustable and set. In this wary the torso may be fixed at an angle for practising upper cut punches to the torso and head.

The mannequin may include a resilient, force-absorbing covering, the covering including slits and/or removed portions in the vicinity of joints to facilitate the positioning of the various limbs relative to the torso. These slits or removed portions, which may be in the form of slivers, prevent the 'bunching-up' of the covering material which may lead to restricted movement of the limbs. The slits or removed portions may be approximately 10 mm in thickness, although other thicknesses are contemplated including wedge-shape portions.

Each hip joint may include a resilient member to permit each upper leg to rotate relative to the torso about any of three axes, the axes being orthogonal to each other. In a similar manner, each ankle attachment means may include a resilient member to permit each lower leg to rotate relative to the support structure about any of three axes, the axes being orthogonal to each other. The resilient member may take the form of a rubber block incorporating two threaded bolts each bolt projecting from opposite sides, the block being attachable to the joint and/or limb and/or torso vi the bolts with associated nut. These resilient members may act in a similar manner to engine mountings in a vehicle and in embodiment may be likened to anti-vibration mountings.

Each lower leg may include a telescopic member for adjusting its length. The position of one of the telescopic members relative to the other may be fixable by appropriate means such as a nut and bolt.

The apparatus may include ankle position adjustment means for varying and fixing the position of each ankle relative to the support structure. These may include telescopic members. The telescopic members may lie substantially horizontally and be connected at one end to the support structure and at the other end to the ankle (or lowest end of each lower leg). The connection from the telescopic rod to the ankle may be by means of a cleavis and pin or a shackle.

The apparatus may include head attachment means for attaching the head to the torso, wherein the attachment means include rotation means for adjustably fixing the position of the head relative to the torso or positions about an axis, to mimic the rotation of a human head about its neck. These rotation means, for varying the angle of the bead relative the torso, may take the form of splines projecting radially from a rod and a corresponding socket including grooves for accepting the splines.

The support structure may include fixing means for fixing it to a wall and/or a frame for floor-standing.

The support structure may be adjustable for adjusting the position of the mannequin relative to the wall and/or the floor, in use.

The support structure may include a resilient member for enabling the upper part of the torso to be pulled downwardly and forwardly in use, the resilient member biasing the torso to an approximate upright position. Springs may be used for this resilient member.

The resilient member may be adjustable so that the force required to overcome the resilient member and pull the upper part of the torso downwardly and forwardly is variable.

The apparatus may further comprise pressure sensors and/or accelerometers for assessing and/or recording the movement of the mannequin and/or the force of any applied strikes to it. These sensors may be attachable to a computer for storage and/or manipulation of the resulting data.

The mannequin may be removable from the support structure, the support structure being configured to receive a support arm for enabling a speed ball or a punch bag to be mounted to it in place of the mannequin.

In one embodiment, the training apparatus has a mannequin for being struck by a person training for fighting, the apparatus comprising a support structure on which the mannequin is positioned, and a mounting frame for the support structure, the apparatus being such that the mannequin is made of a force-absorbing material, the support structure having legs which are connected to force-absorbing means for absorbing the force of blows from the person to the legs of the mannequin, the support structure having a trunk which rotates such that a head of the mannequin supported on the support structure and above the trunk always faces the person, at least one of the support structure and the mounting frame being adjustable for adjusting the height of the apparatus to be appropriate to the height of the person; and at least one of the support structure and the mounting frame being adjustable for adjusting to the posture of the person.

The apparatus may be one in which the force-absorbing means for absorbing the force of blows from the person to the legs comprises at least one resilient member for each leg, and a telescopic arrangement for each leg. The spring will usually be a coil spring but other types of spring may be employed. Other types of force-absorbing means may be employed. The resilient member may be a spring, a rubber washer, or a flexible material. The telescopic arrangement for each leg may be a piston and cylinder arrangement. The piston and cylinder arrangement may be a gas spring or a hydraulic spring. Each leg may be positioned at 90° to the support unit, for example in order to facilitate making the legs adjustable.

The apparatus may be one in which the support structure has resilient means for enabling an upper part of the support structure and an upper part of the mannequin to be pulled downwardly towards the person and struck by the person. The apparatus is then especially useful for persons training for types of fighting involving knee strikes. The resilient means preferably comprises at least one spring, elastic material, or a gas piston. The spring will usually be a coil spring.

Advantageously, the resilient means simultaneously enables a lower part of the mannequin and the support structure to move away from the person. The apparatus may include adjustment means for adjusting the force required to pull the upper part of the mannequin towards the person.

The apparatus may be one in which the support structure is adjustable for adjusting the height of the apparatus by baring legs which are adjustable in height. Alternatively or in addition, the support structure may be adjustable in height for adjusting the height of the apparatus to be appropriate to the height of the person using the apparatus.

Additional joints may be positioned elsewhere on the support structure as may be desired. The adjustment of the posture of the mannequin may enable the mannequin to be switched between southpaw and orthodox guard stances. The adjustment may alternatively or additionally be such as to enable adjustment of the guard stance into different positions whilst in southpaw stance or in orthodox stance.

Rotation, for example trunk rotation, of the support structure may be limited by appropriate rotation-limiting means to mimic southpaw and orthodox structures, and also to prevent the mannequin from spinning around if this would otherwise be the case.

The apparatus may be provided with fixing means for fixing joints in the solid static position. Alternatively the apparatus may be provided with means to adjust tension so that arms or legs can move. Tension on a joint can vary to the level of the force required by the user for moving arms and/or legs. The joints may be designed such that the force is localised to specific points in the joints. If the joints break, they can then be easy to repair. The joints may use appropriate radii to alleviate stress in the joints.

The joints may be adjustable friction joints so as to control movement of the support structure and the mannequin on the support structure in dependence on the amount of friction provided by the adjustable friction joints. The tension set by the user will normally determine the amount of friction. The adjustable friction joints may have tightening means for tightening or loosening the adjustable friction joints in order to increase or decrease the friction afforded by the friction joints, and to secure parts in desired fixed relative positions. The adjustable friction joints may have teeth or abrasive material washers for providing friction. The adjustable friction joints may comprise an outer joint portion and an inner joint portion, the outer joint portion being constructed to break before the inner joint portion, thereby facilitating repair.

The support structure may have knee joints that are made of a material which causes the knee joints to be lightweight and strong enough to resist blows from the person, whilst being flexible with a high yield point. The material may be a composite material. Other materials may be employed.

The support structure may have ankles which are telescopic ankles. In this case, the apparatus may be one in which the ankles are connected to shackles which allow the legs to be height adjustable, and which also allow the legs to be moved backwards and forwards. The ankles may be removed from the shackles by the use of split pins.

The apparatus of the present invention may include a covering material which allows for the height adjustment and the movement. The covering material may be a plastics material, a tough fabric, or a rubber material. The plastics material may be a polyvinyl material. The covering material may be plain or ribbed. The covering material may allow for movement when adjusting the height of the mannequin and/or the support structure. Also, the covering material may be such that when the mannequin rotates the trunk, the covering material allows the torso to move freely.

The apparatus may be one in which the support structure is for being mounted to a wall. Alternatively, the apparatus may include a free-standing frame for siting on a floor. The floor standing frame may comprise a removable and adjustable cage, a cage floor, and weight means for weighting it down. The weight means may be sand in at least one movable container and/or water in at least one movable container. The frame operates to prevent the apparatus moving over the floor when the apparatus is being used.

The apparatus may include sensors. The sensors may be multi-directional accelerometer movement sensors and/or resistance sensors. The sensors may be linked to a computer. The use of the computer will enable the apparatus to be interactive on one or more of the speed, power, accuracy and reaction rime of the person using the apparatus of the present invention. The sensors may be strapped or otherwise attached to the mannequin. A sensor control device may be embedded in the mannequin so that it can easily be removed. The sensor control device may be located elsewhere on the apparatus if desired.

The apparatus nay be one in which the mannequin is removable from the support structure, and in which the mounting frame is constructed to receive a tripod support arm for enabling a floor-to-ceiling speed ball to be mounted between the support arm and an upper arm of the support structure. When the mannequin is removed from the support structure, then the support structure may be also used to support a heavy exercise bag, for example from a top part of the support structure. The tripod support arm may be used to provide any necessary required additional support.

The apparatus may be one in which the mannequin is removable from the support structure such that the mannequin is able to be used by the person for ground and pound exercises, jujitsu, and wrestling on the floor.

The mannequin may be removably secured to the support structure by split pins. Removable securing means other than split pins may be employed.

The various parts of the apparatus may be made in various suitable and appropriate materials. Thus, for example, the components of the support structure on which the mannequin is positioned may be made of a metal such for example as steel or chromium-plated steel. Other materials for the support structure include a composite material, or a combination, of steel with bonded rubber for providing flexibility. The mannequin may be covered in a thermo plastics material, or polyvinyl fabric materials. Such materials may form the external cover or skin of the mannequin. The mannequin may be provided with an internal coveting of a force-absorbing material such for example as polyurethane foam. Sensors may be secured to the mannequin using straps attached to the force-absorbent material. The straps may be made, of leather, a fabric, or a plastics material such for example as a polyvinyl material or a thermoplastics material. The mannequin may take various forms such for example as that of a human, a humanoid, an animal, a cartoon character, or a dummy.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

FIG. 7 is a side view of the apparatus shown in FIG. 2, with an enlarged elbow joint part;

FIG. 8 is a view from the rear and one side of the mannequin shown in FIG. 2, with an enlarged shoulder joint part;

FIG. 9 is a side view of the apparatus as shown in FIG. 2, with an enlarged knee joint part;

FIG. 10 is a view from the rear and one side with an enlarged knee joint part;

Figure 2:
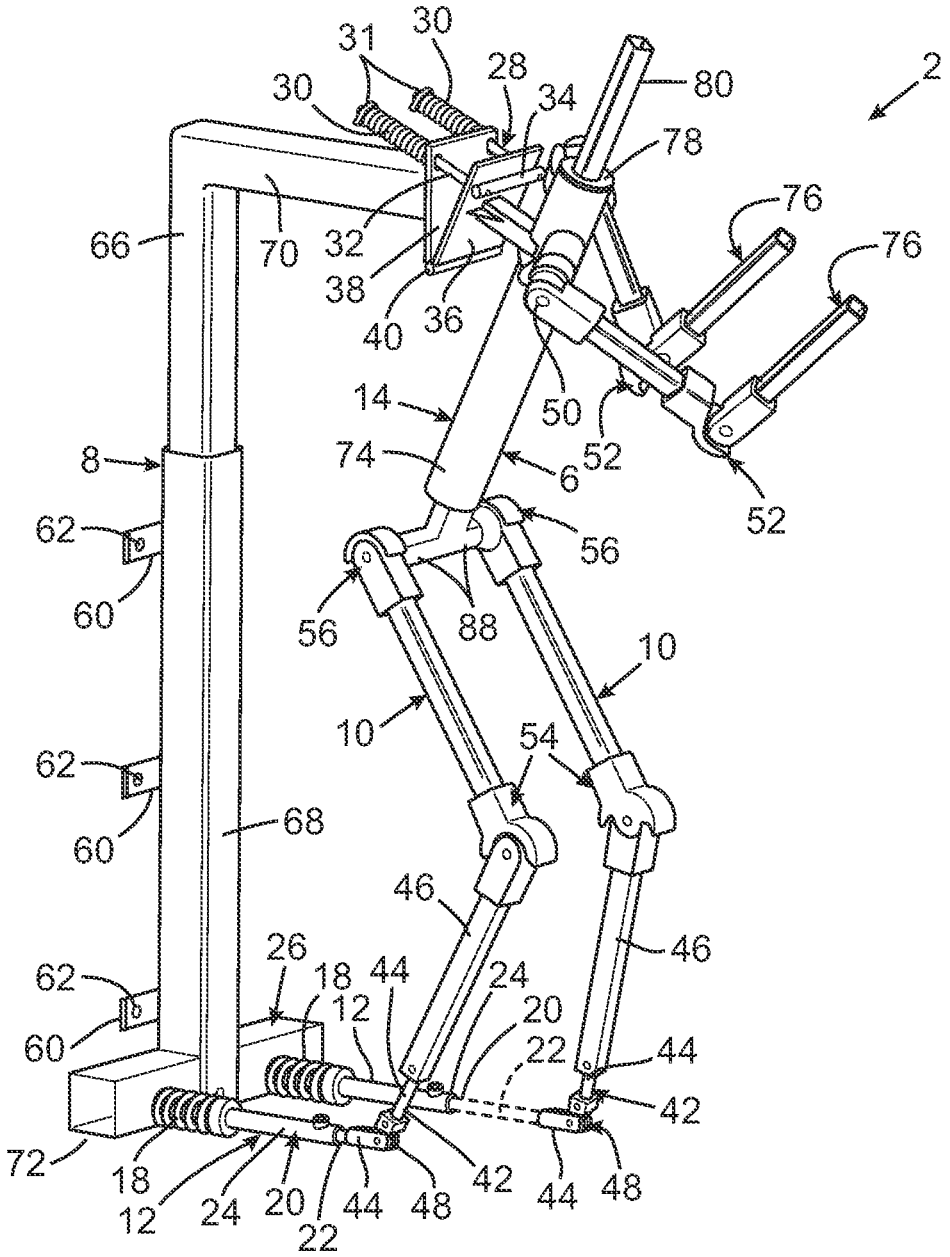
FIG. 2 is a view of the apparatus shown in FIG. 1 but without the mannequin.
Figure 3:
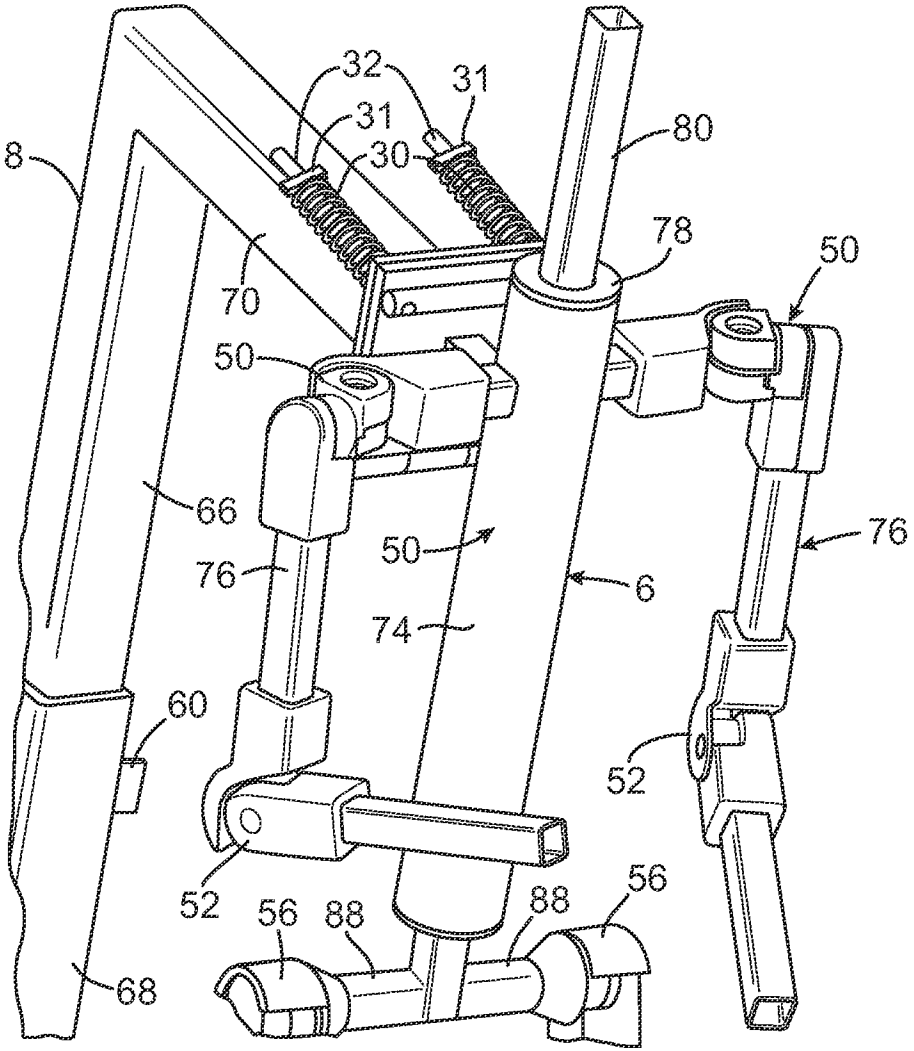
FIG. 3 is a view from the front and one side of a top part of the support structure and mounting frame shown in FIG. 2.
Figure 4:
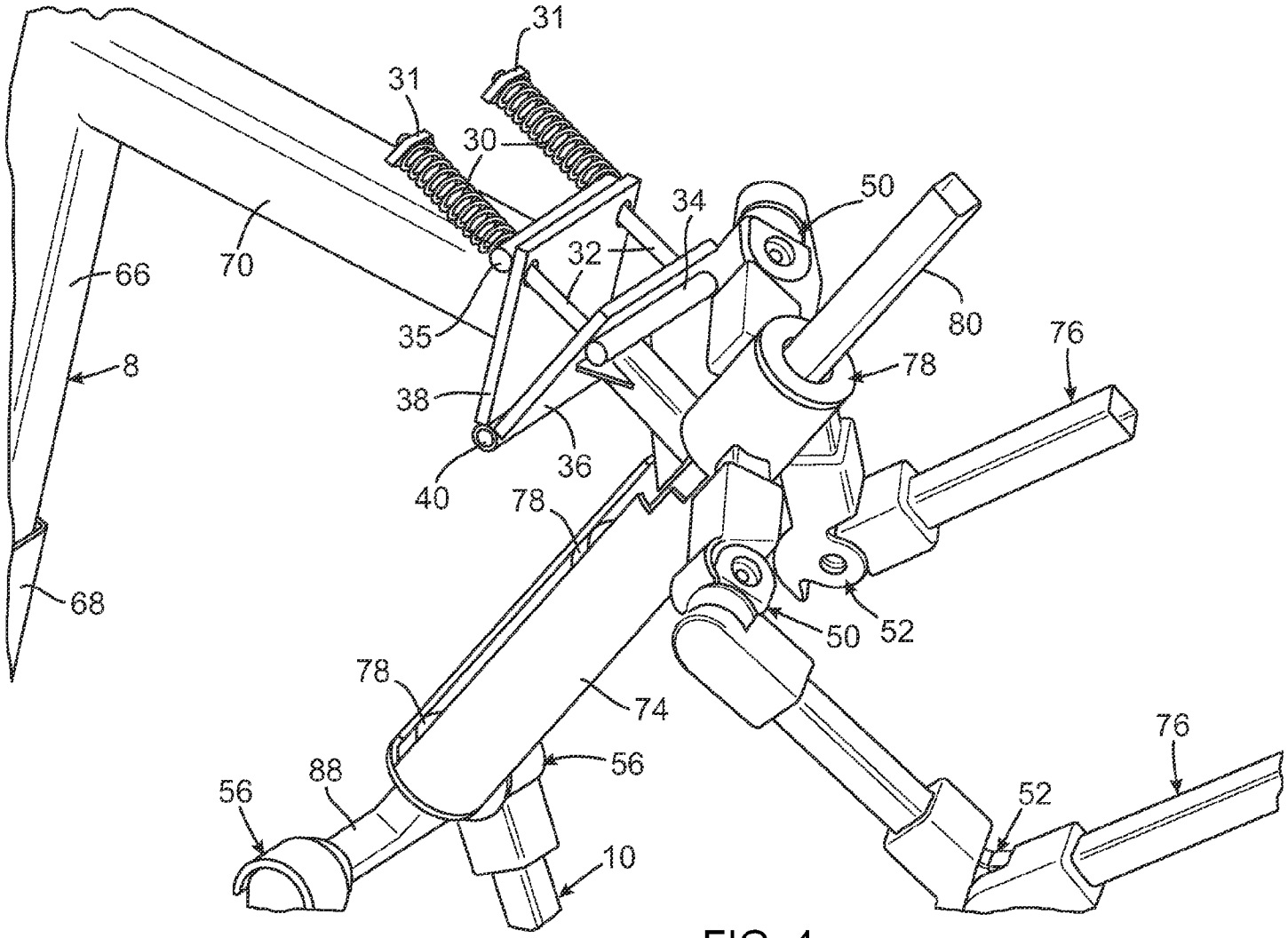
FIGS. 4 and 5 are views from the rear and one side of the top part of the support structure and the mounting frame shown in FIG. 3.
Figure 12:
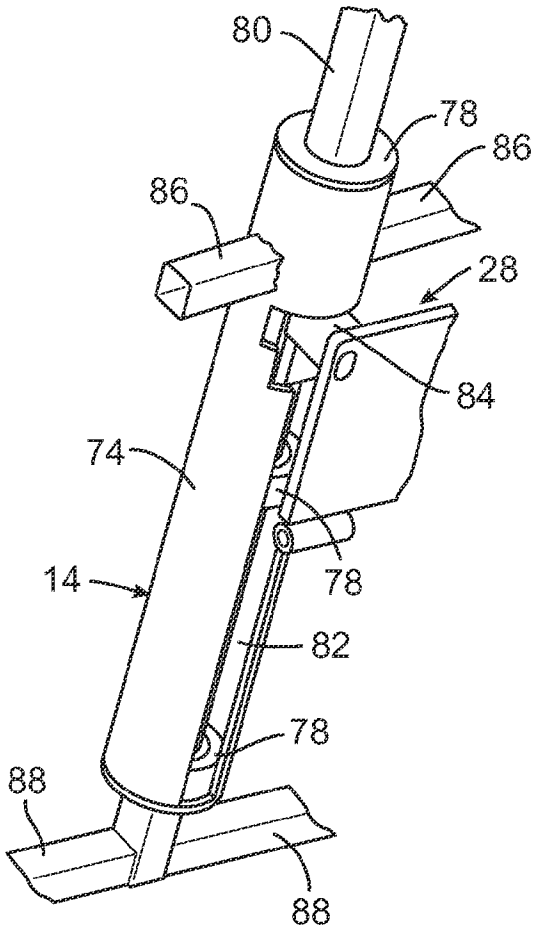
Figure 13:
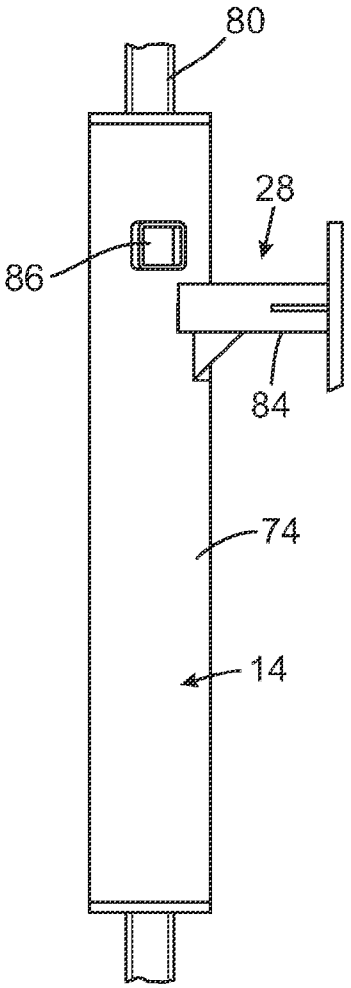
Figure 15:
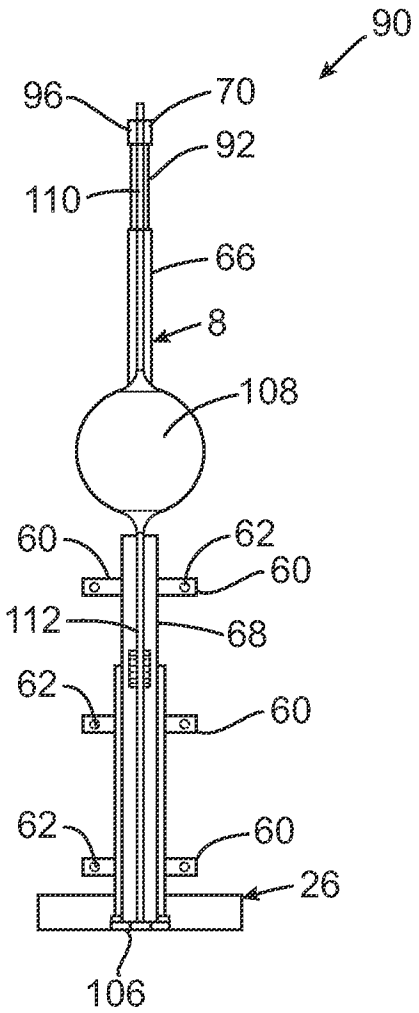
Figure 14:
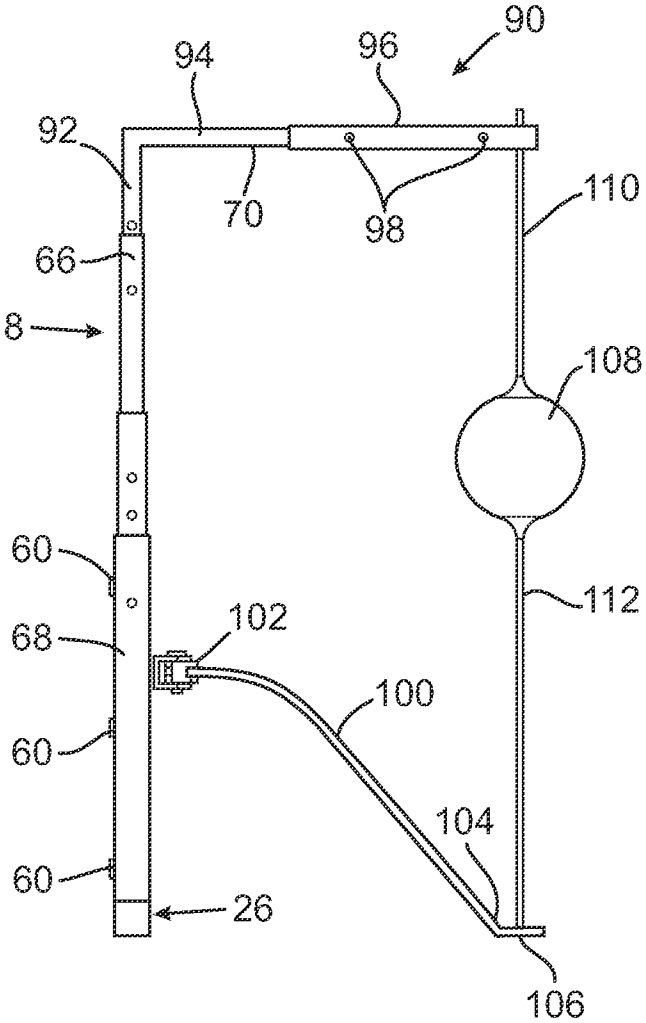
Figure 16:
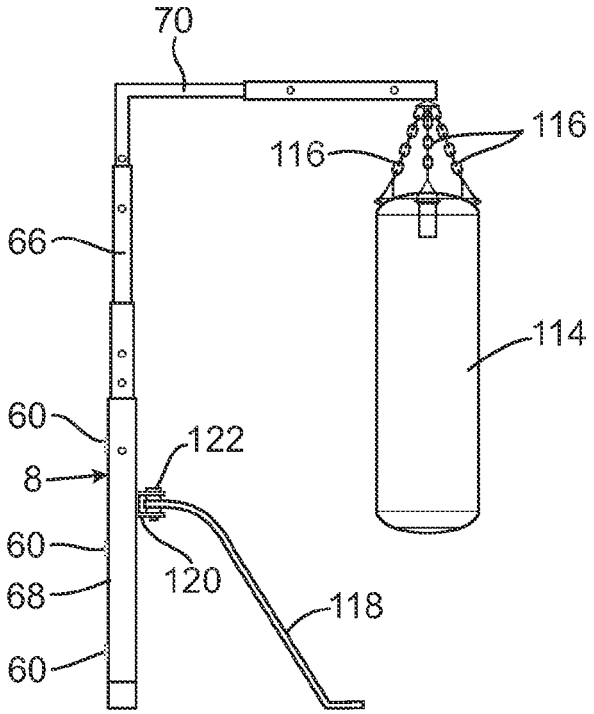
Figure 17:
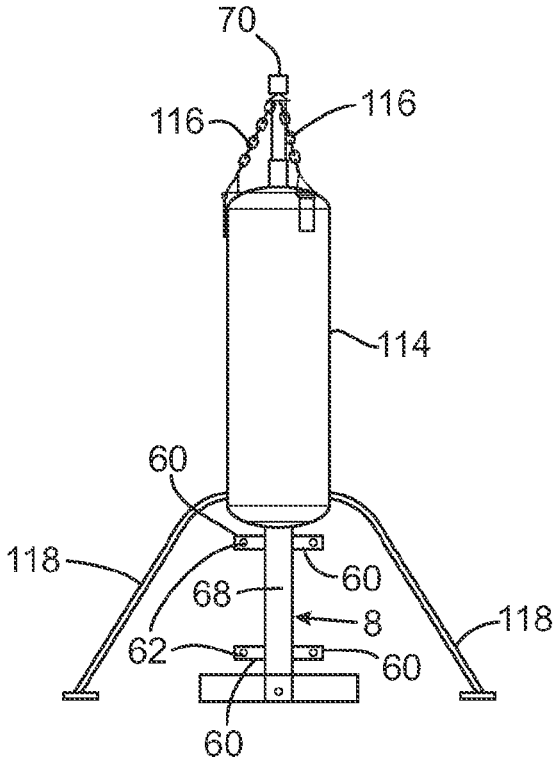
Figure 18:
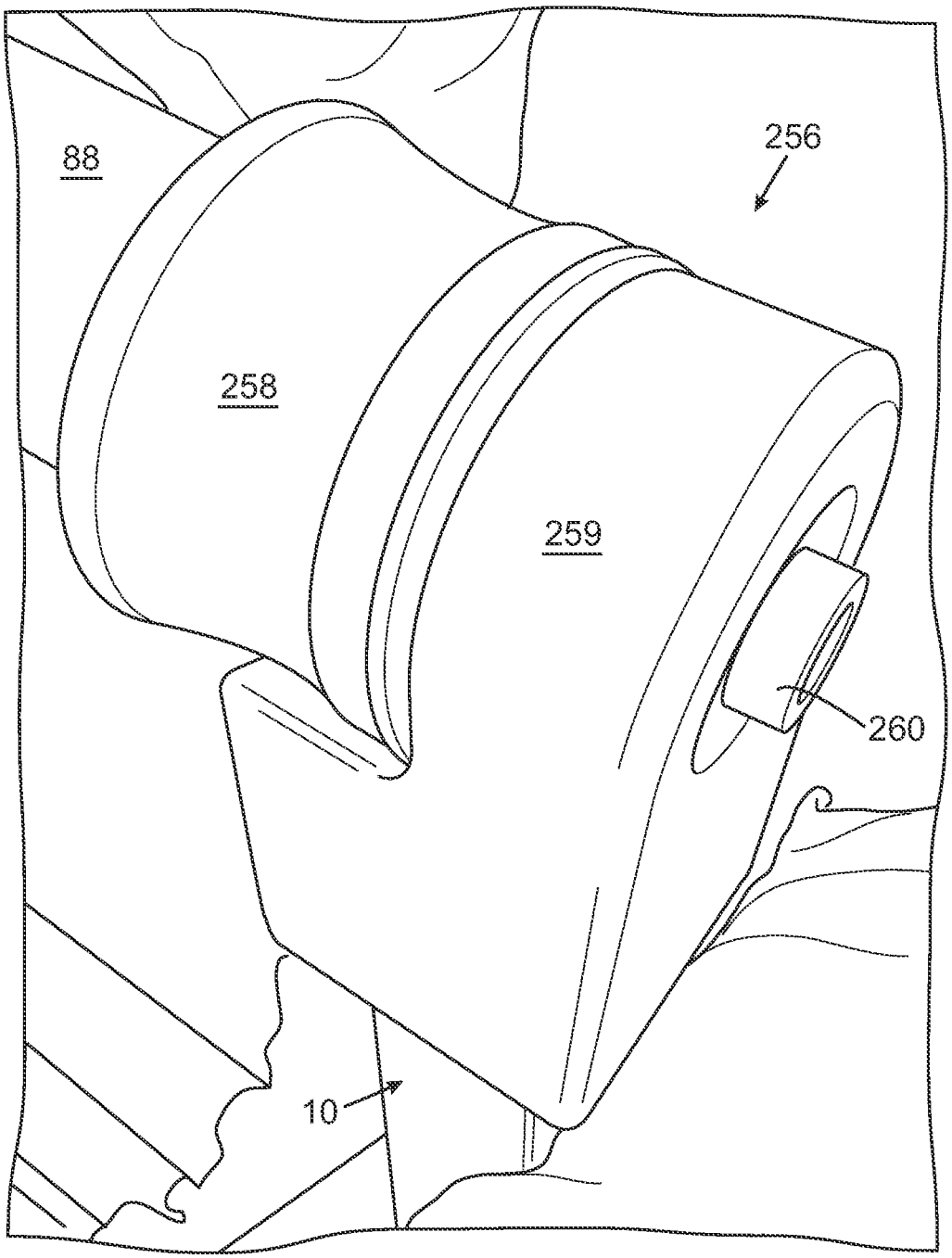
Figure 19:
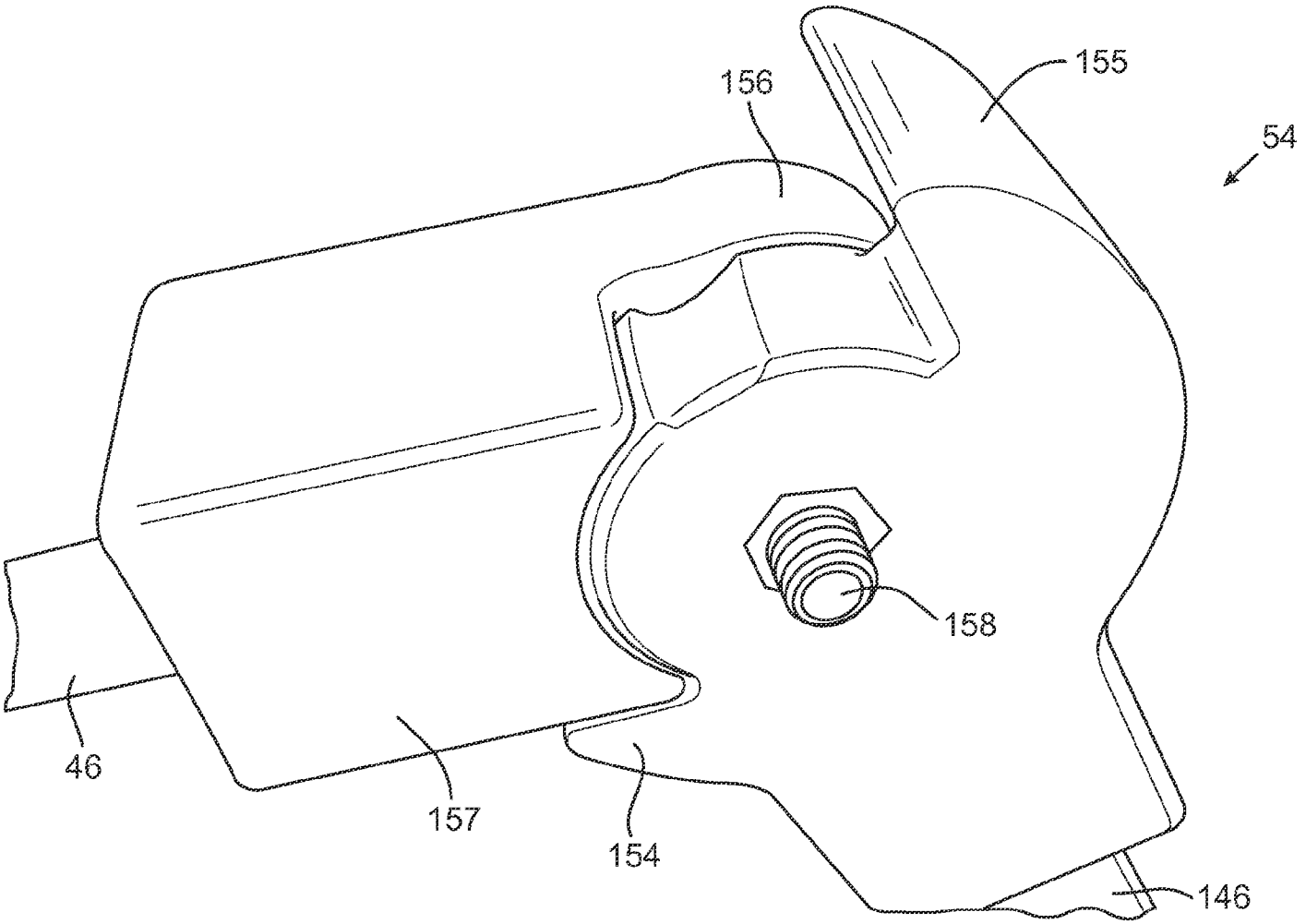
Figure 20:
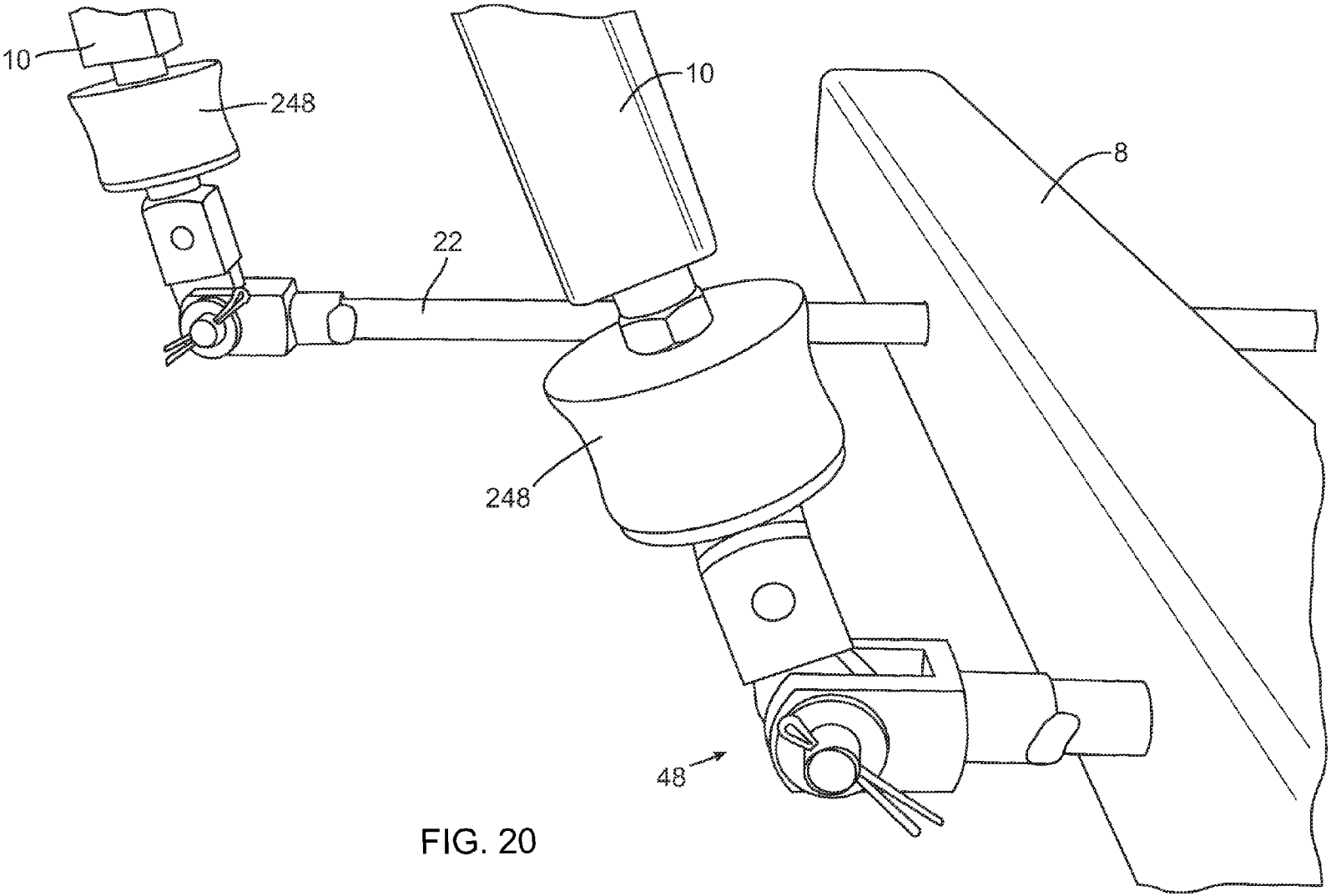
Figure 21:
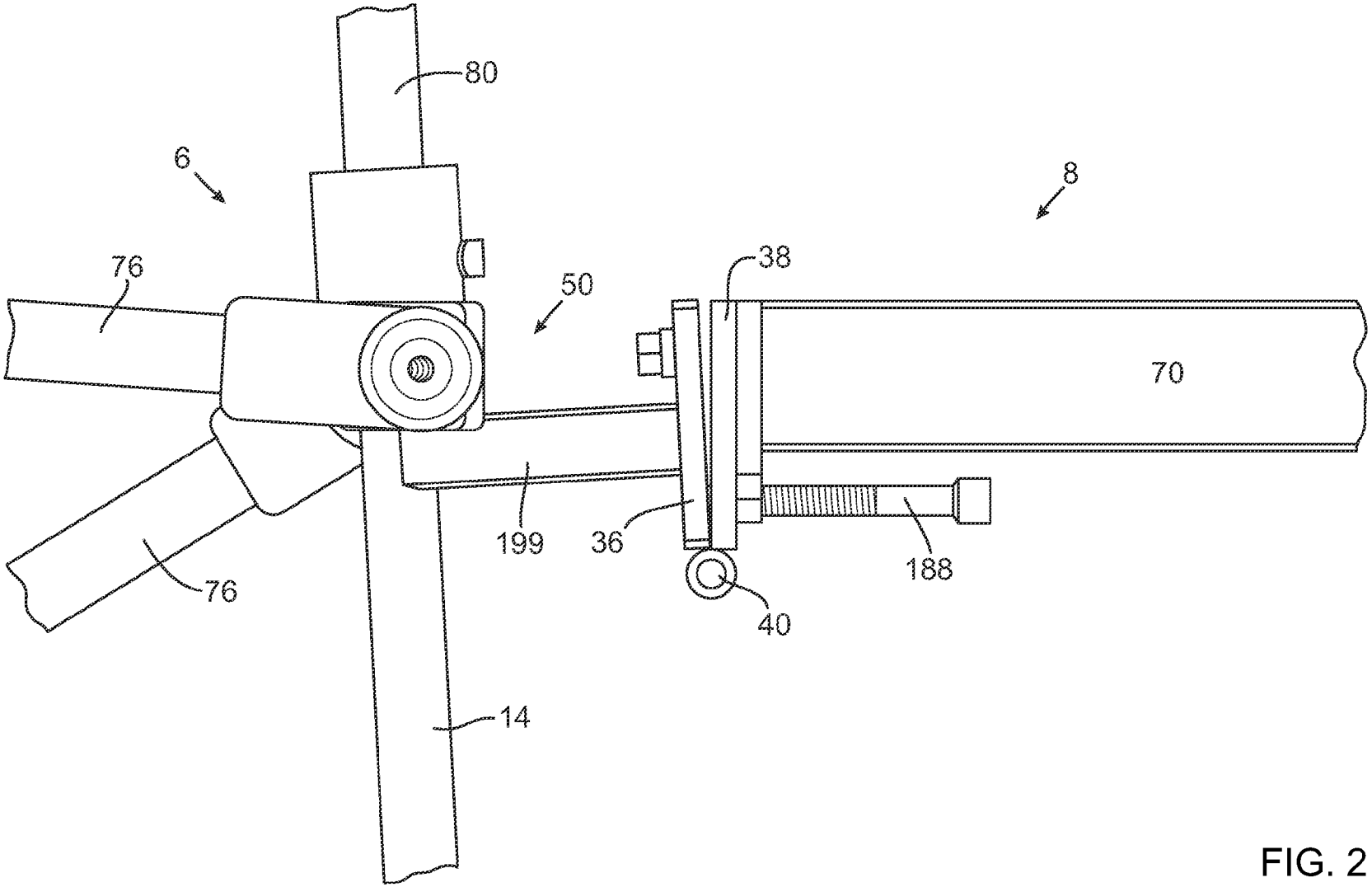

FIG. 11 shares the view of the apparatus as shown in FIG. 10 and it includes an enlarged shoulder joint part;

FIG. 12 is a view from the front and one side of a trunk part of the support structure shown in FIG. 2;

FIG. 13 is a side view of the trunk part of the support structure shown in FIG. 12;

FIG. 14 shows part of second apparatus of the present invention with the apparatus being produced for having a mannequin not shown) for being struck by a person training for fighting, and with the apparatus being such that the mannequin is able to be removed and replaced by a speed-ball;

FIG. 15 is a front view of the apparatus shown in FIG. 14;

FIG. 16 is a side view illustrating how apparatus of the present invention is able to be modified to support a punch bag;

FIG. 17 is a front view of the apparatus as shown in FIG. 16;

FIG. 18 is a perspective view of possible anti-vibration mounting for the hips;

FIG. 19 is a perspective view of another possible knee joint;

FIG. 20 is a perspective view of anti-vibration mountings at the ankles; and FIG. 21 is an elevational side view of part of the support structure and part of the skeleton.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like, in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising" used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may refer to different embodiments. Furthermore, the particular features, structures or characteristics of an embodiment or aspect of the invention may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may, in some embodiments, mean only one.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

Referring to FIGS. 1-13, there is shown apparatus 2 having a mannequin 4 for being struck by a person training for fighting. The apparatus 2 comprises the mannequin 4, a skeleton 6 on which the mannequin 4 is positioned, and a support structure 8 for supporting the mannequin via the skeleton 6.

The apparatus 2 is such that the mannequin 4 is made of an internal force-absorbing material, and an external flexible skin. The mannequin 4 is in the shape of a human being.

The skeleton 6 has legs 10 which are connected to force-absorbing means 12 for absorbing the force of blows from the person to the legs 10 of the mannequin 4. However, in one embodiment, the force-absorbing means 12 are omitted such that the positions of the ankles 48 relative to the support structure 8 are variably fixed.

The skeleton 6 has a trunk 14 which rotates such that a head 16 of the mannequin 4 supported on the support structure 6 and above the trunk 14 may always face, the person training for fighting. The skeleton 6 also enables shoulders of the support structure to rotate to form different postures.

Both of the skeleton 6 and the support structure 8 are adjustable for adjusting the height of the apparatus 2 to be appropriate to the height of the person and/or the posture or stance of the person. This facility enables the apparatus to be of a height appropriate for a short, medium or tall person training for fighting, and it also enables the apparatus to be appropriate for a person with an orthodox or a non-orthodox fighting stance.

Figure 6:
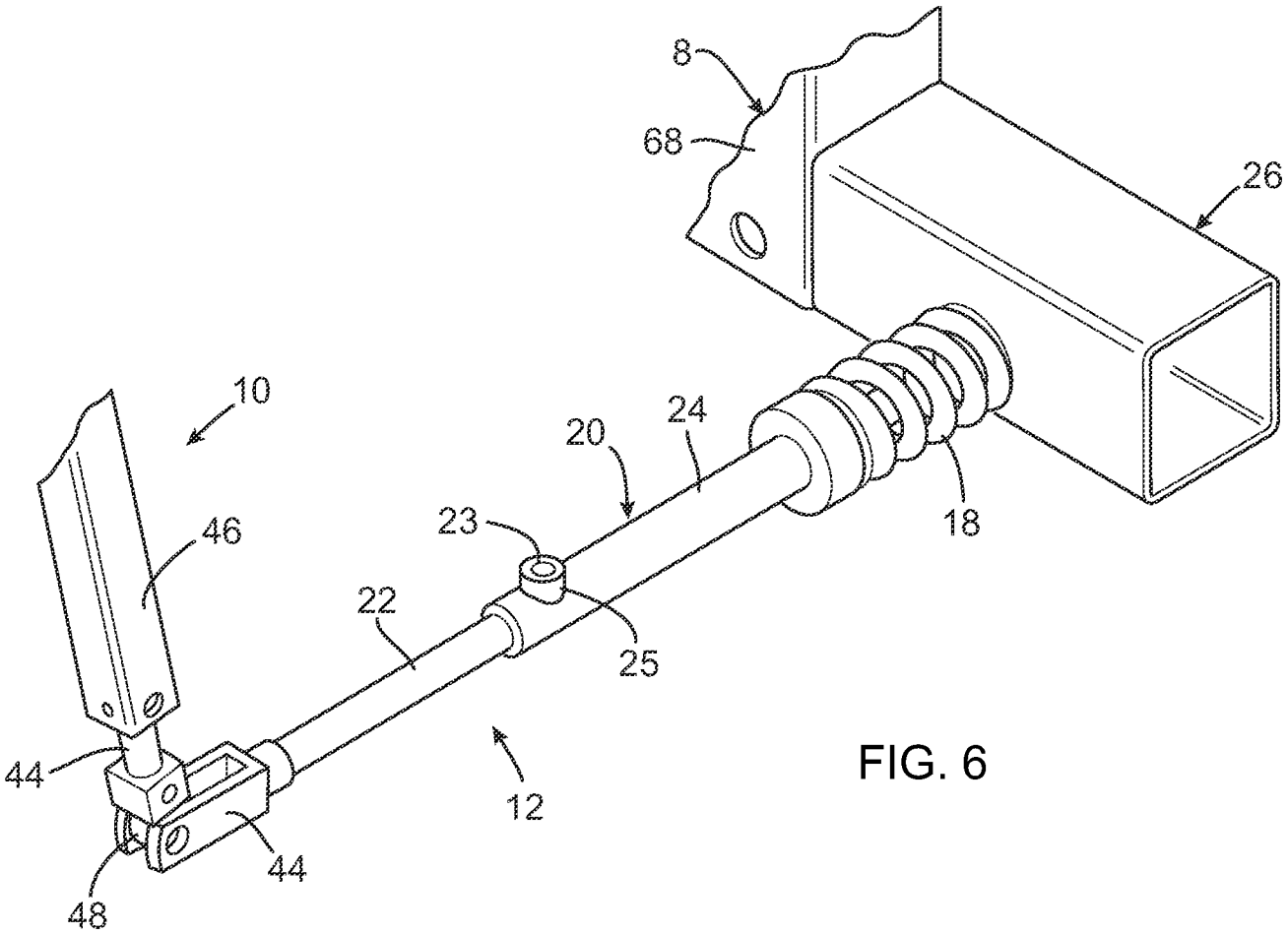
FIG. 6 is a view from the front and one side of the force-absorbing means for absorbing the force of blows from the person to a leg of the mannequin.

The force-absorbing means 12 for absorbing the force of blows from the person to the legs 10 comprises a coil spring 18 for each leg 10, and a telescopic arrangement 20 for each leg 10. Each telescopic arrangement 20 comprises a rod 22 which slides in and out of a tube 24. The rod 77 is locked in position by a screw 23 which operates in a formation 25 as shown in FIG. 6. The telescopic arrangement 20 may alternatively be a gas spring or a hydraulic spring. Each coil spring 18 enables the telescopic arrangement 20 to be mounted such that the telescopic arrangement 20 may pivot at different angles with respect to a base part 26 of the support structure 8. The skeleton 6 has resilient means 28 for enabling an upper part of the skeleton 6 and an upper part of the mannequin 4 to be pulled towards the person and struck in the person. The use of the resilient means 28 is especially useful for persons training and wishing to employ knee strikes at the mannequin 4. The resilient means 28 comprises two coil springs 30. Each coil spring 30 is mounted on a mounting rod 32 and held in position by a nut 31. The nuts 31 can be tightened or loosened to adjust the force required to pull down the mannequin 4. The mounting rod 32 is connected by a connecting rod 34. The connecting rod 34 is on one side of a plate 36. The coil springs 30 are on an opposite side of a plate 38. The mounting rods 32 pass through apertures in the plates 36, 38. The springs 30 abut against a connecting rod 35 which rests against the plate 38 as shown. The plates 36, 38 are able to pivot towards and away from each other by means of a hinge 40. In alternative embodiments (not shown) only one, or more than two, of the coil springs 30 may be employed. Similarly one, or more than two, of the mounting rods 32 may be employed.

The skeleton 6 is adjustable for adjusting the size of the apparatus 2. More specifically, the skeleton 6 has legs 10 which are adjustable in height. The legs 10 are adjustable to height by means of telescopic arrangements 42. There is one telescopic arrangement 42 for each leg 10. Each telescopic arrangement 42 comprises a rod 44 which slides backwards and forwards within a shin part 46 of each leg 10. Each rod 44 is connected to its telescopic arrangement 20 by means of an ankle joint 48. The ankle joint 48 enables the telescopic arrangement 42 to pivot backwards and forwards and at other angles with respect to the telescopic arrangement 20.

The skeleton 6 has joints which enable the mannequin 4 to have an adjustable guard stance. More specifically, these joints include shoulder joints 50, elbow joints 52, knee joints 54 and hip joints 56.

The legs 10 are adjustable in position. More specifically, the legs 10 are adjustable in position by the ankle joints 48 which are adjustable, and by the knee joints 54 which are also adjustable, and by the hip joints 56 which are also adjustable.

One or more of the shoulder joints 50, the hip joints 56, the elbow joints 52, and the knee joints 54 may be adjustable friction joints which are able to control movement of the skeleton 6 and the mannequin 4 on the skeleton 6 in dependence on the amount of friction produced by the adjustable friction joints.

The skeleton 6 is such that the knee joints 54 may be made of a composite or non composite material. The material may have characteristics which enable the knee joints 54 to be strong enough to resist blows from the person, whilst being flexible with a high yield point.

The piston and cylinder arrangements 20 enable the skeleton 6 to have telescopic ankles. The piston and cylinder arrangements 42 each include a shackle 44 which allows the legs 10 to be height adjustable, and which also allows the legs 10 to be moved backwards and forwards. The shackles 44 are covered with a covering material for allowing height adjustment and movement. The covering material may be a plastics material or a rubber material. The covering material may be plain or ribbed. The covering material may be in the form of a boot or other design of cover.

Figure 1:
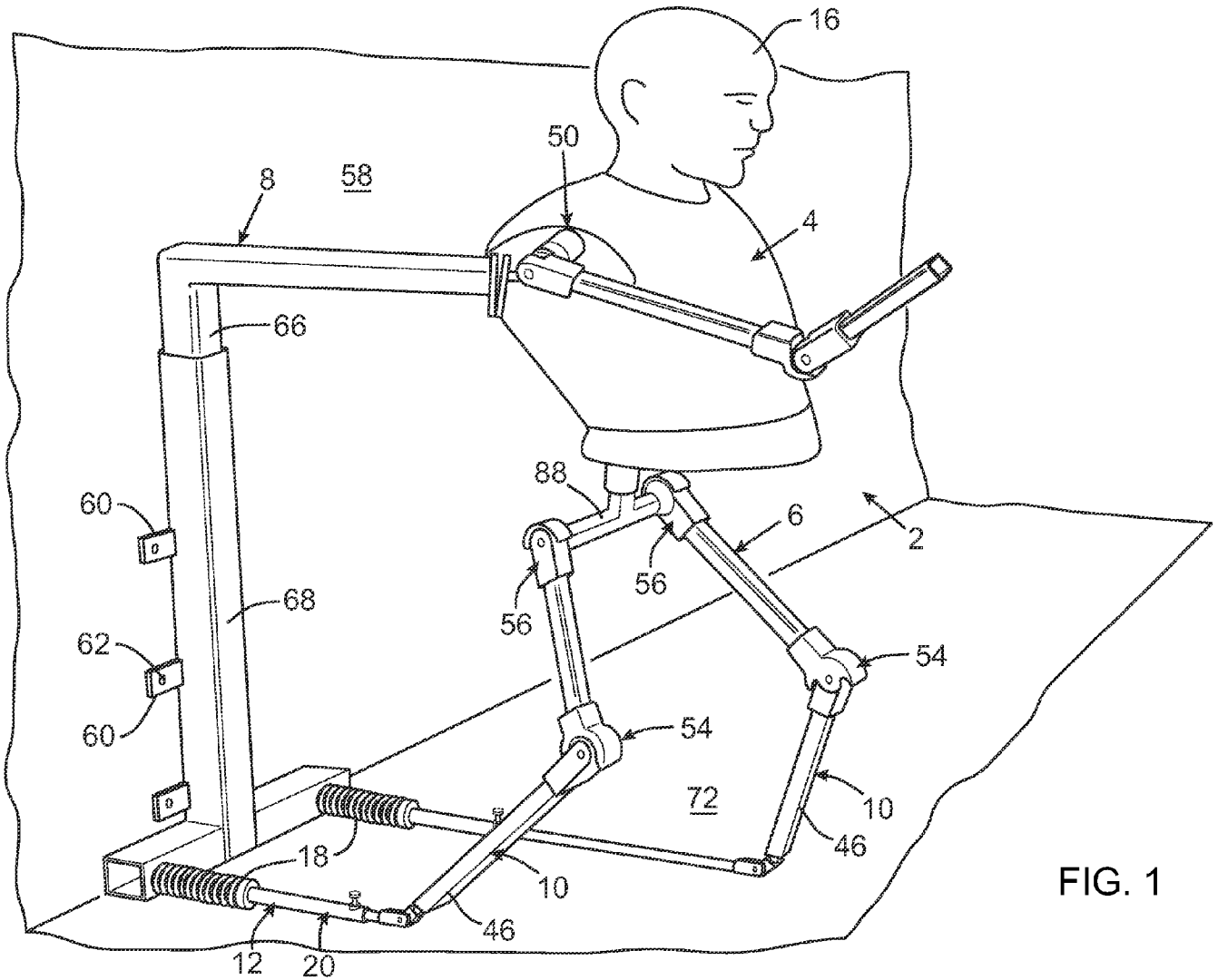
FIG. 1 shows first apparatus having a mannequin for being struck by a person training for righting, the lower part of the mannequin ha rug been omitted for enabling viewing of a part of a support structure on which the mannequin is positioned.

As shown in FIG. 1, the support structure 8 is for being mounted to a wall 58. For this purpose, the support structure 8 has lugs 60. Each lug 60 has an aperture 62 for receiving a bolt 64 which bolts into the wall 58. The support structure 8 has a telescopic part 66 which slides into and out of a fixed part 68 in order to adjust the height of a mounting part 70 above the floor 72. The arrangement also allows for changing the use of the apparatus by removing the mannequin 4 as will be described herein below with reference to FIGS. 14 and 15.

FIGS. 11 and 12 illustrate how the trunk part 14 comprises an outer cylindrical tube 74 on which arms 76 of the mannequin 4 are mounted. The tube 74 is rotatably mounted by rotatable joint means 78 on a support part 80. The use of the rotatable joint means 78 enables the trunk 14 to pivot with respect to the hip joints 56 and thus the arms 76 are able to adopt a different stance with respect to the legs 10. In addition, by virtue of the elbow joints 52, the arms 76 are able to be bent to adopt a different stance. Similarly, by virtue of the knee joints 54, the legs 10 are able to bend and thus adopt different stances, for example from a crouching stance to an upright stance.

The cylindrical tube 74 is able to rotate axially around the fixed box section spine. This is achieved by three equispaced bearing assemblies filling the void between the inner part of the cylindrical tube 74 and the outer part of the box section spine. The bearing assemblies each comprise an inner steel ring fitted around the box section spine and welded in position. The bearing assemblies also each comprise a nylon "tyre" which is press fitted onto the outer diameter of the inner steel ring. The outer diameter of the nylon "tyre" has a smooth sliding fit for interfacing the inner diameter of the cylindrical tube.

Figure 5:
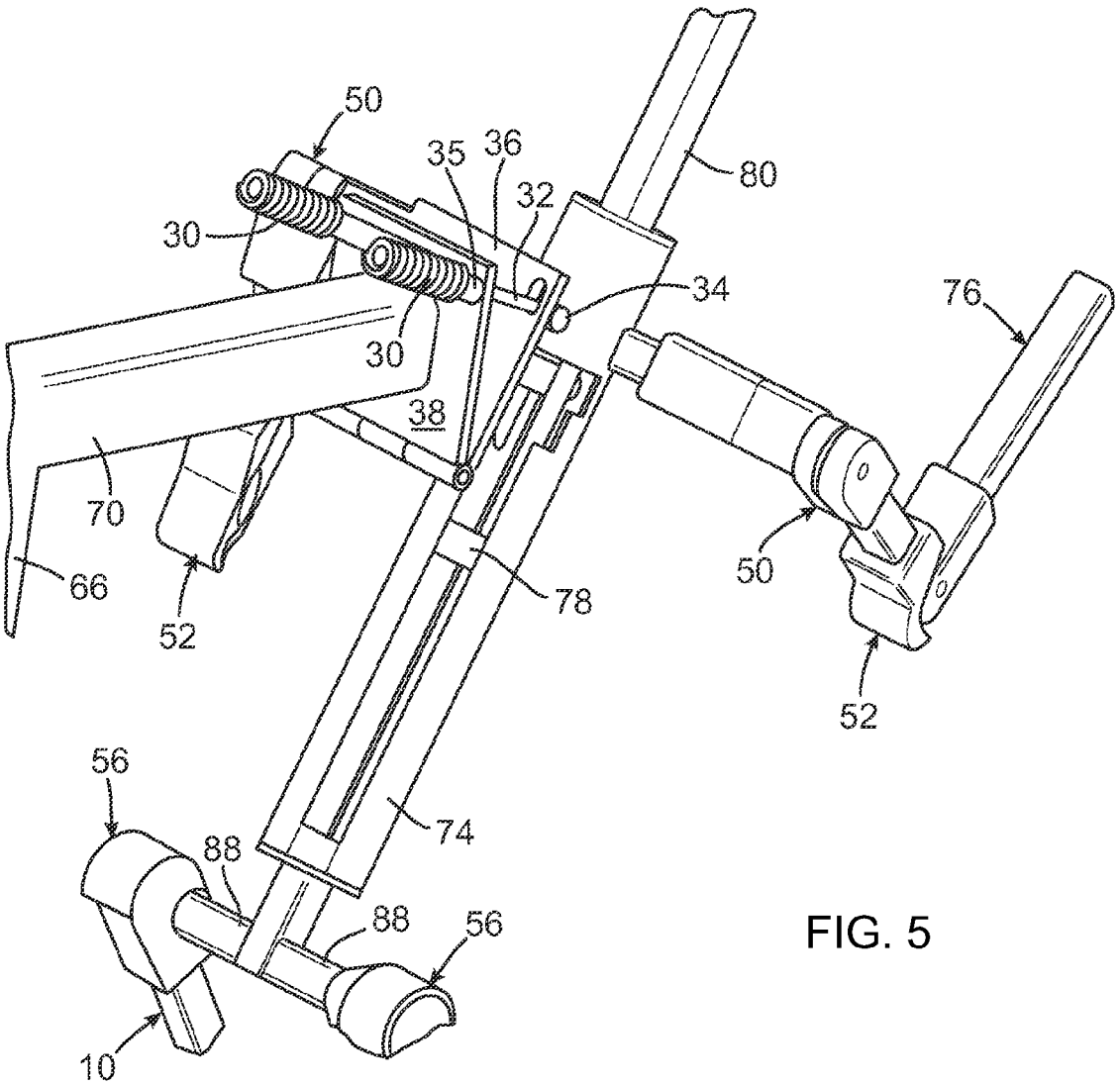

When the mannequin 4 and its support structure 6 is pulled towards the person during training, for example for a knee strike, the resilient means 28 needs to move relative to the trunk 14 since the trunk 14 will effectively be pulled towards the person training, and downwardly towards the floor 72. FIGS. 12 and 13 show how this is accomplished. More specifically, the rear part of the tube 74 has a longitudinal slot 82. A part 84 of the skeleton 6 supports the resilient means 28, and is able to slide in the slot 82. FIGS. 12 and 13 also show how the skeleton 6 comprises shoulder parts 86 to which are mounted the shoulder joints 50. FIG. 12 also s lows how the support part 80 is connected to support parts 88 to which are mounted die hip joints 56. FIG. 5 also illustrates the sliding action required for enabling the mannequin 4 to be pulled forwards and downwardly for a knee strike by the person doing the training.

As the person pulls the head 16 of the mannequin 4 towards himself or herself, the hip joints 56 and the support parts 88 move backwards. The hip joints 56 may also move upwards.

Referring now to FIGS. 14 and 15, there is shown part of apparatus 90 which is like the apparatus 2 and in which similar parts as in the apparatus 2 have been given the same reference numerals for ease of comparison and understanding. Thus the apparatus 90 has a mounting frame 8. The mounting frame 8 in the apparatus 90 is such that the mounting frame 8 has the telescopic parts 66, 68 and also a further telescopic part 92 which locates in the telescopic part 66.

In the apparatus 90, the mounting part 70 is also telescopic and it comprises a first part 94 and a second part 96. The parts 94, 96 are adjustable with each other and are able to be located in position by pin and aperture arrangements 98. An arm 100 locates at a first end 102 to the fixed part 68 of the mounting frame 8. The other end 104 of the arm 102 fixes to the floor 72 by means of a fixing plate 106. A speedball 108 is then able to be mounted between the fixing plate 106 and the second part 96 of the mounting part 70 by means of elasticated cords 110, 112. The apparatus 90 is such that the mannequin which is usually used can easily be removed and replaced by the speedball 108 so that the apparatus 2 can then be used for speedball training if it is not desired to train both the mannequin 4.

FIGS. 16 and 17 illustrate how the apparatus of the present invention is able to be modified to support a punch bag 114. The punch bag 114 hangs by three chains from the mounting part 70 of the support structure 8. The mounting part 70 is telescopic as can best be appreciated from FIG. 16. This allows the punch bag 114 to be supported at an appropriate distance from the parts 66, 68 of the support structure 8. A pair of legs 118 attach to a bracket 120 on the support structure 8 as shown. The attachment of the pair of legs 18 may be by means of a pin 122 or other fixing means such for example as a bolt. The legs 118 together with the part 68 of the mounting frame 8 form a tripod arrangement as can best be appreciated from FIG. 17. The tripod arrangement gives good stability to the apparatus when being used with the punch bag 114.

If the support structure includes a floor-standing frame, then it may be weighted down with weight means such for example as sand and/or water in appropriate containers. The apparatus 2 may include sensors which are linked to a computer for enabling the apparatus 2 to be interactive on, for example, speed and/or power of a user of the apparatus 2. The coil springs 18 may alternatively be flexible mounting means such for example as rubber pads, rubber washers or other rubber devices bonded to the tube 24 and the base part 26 of the support structure 8.

FIG. 18 shows another possible hip joint 256. Visible is a portion of the support part 88 on which a portion of leg 10 is shown supported. At the top of the leg 10 a plastic part 259 is shown. This is fixed to the top of the leg 10. Fixed to the support part 88 is a rubber member (anti-vibration mounting) 258. This mounting includes an embedded bolt (not visible) lying co-axial with the support part length 88. The bolt extends through the plastic part 259 and is fixed to it with a nut 260. The plastic part 259 and rubber member 258 are rotatable relative to one another about the bolt. However, the rubber member 258 may also bend and thus allow the support part 88 to move and/or rotate relative to the leg 10 in any of the three cardinal axes. The nut 260 may be tightened to increase the friction between the rubber member 258 and the plastic part 259 so as to increase the amount of force required to be exerted on the leg 10 in order to rotate it about the bolt 260 relative to the support part 88.

These types of mountings may also be used elsewhere on the mannequin and its skeleton 6.

In FIG. 19, another knee joint 54 is shown. It has a knee cap 155 which forms part of the joint-piece attached to the upper leg 146. The lower leg 46 includes a joint-piece 157 attached at its end. The two pieces are rotatably joined together by a nut and bolt assembly 158. The knee cap 155 prevents the upper leg from rotating past a certain point with respect to the lower leg. This prevents locking of the knee joint as described herein. The upper piece also includes a projection 154 which prevents the upper leg 146 and lower leg 46 from bending too much. These features help to mimic the human body.

In FIG. 20 the lower legs 10 are visible. At the lowest point of each leg an ankle joint 48 is provided. Anti-vibration mounts 248 are provided between the legs 10 and the ankles 48. These include rubber members with a bolt projecting from each opposite side. The bolts may be used to attach the member to the leg and the ankle joints. These mountings allow a certain amount of movement of the legs relative to the ankles and the torso above in any one or more of the three cardinal axes.

Each ankle 48 is connected by a telescopic rod 22 to the support structure 8 to allow the position of the ankles relative the support structure to be adjustably fixed.

The ankles 48 include shackles, pins and split pins to fix them to the rods 22.

In FIG. 21, part of the skeleton 6 is shown without the mannequin covering layer. It is shown attached to part of the support structure 8. The support structure 8 shown includes the mounting part 70, at one end of which two hinged 40 plates 36, 38 are provided. A bar 199 projects from the outer-most plate 36 and connects to the trunk 14 to thereby support the skeleton 6.

The two upper anus 76 are shown, one of which is shown as projecting from the shoulder joint 50. The support part 80 is shown extending upwardly from the trunk 14. The head (not shown) may be supported by this support part 80.

The angle of the torso 14 relative to the support structure 8 may be adjusted by means of pulling the torso forwards such that plates 36, 38 rotate relative to one another about hinge 40.

Resilient means have been described above which bias the torso 14 to an approximate upright position such that when the torso is released from being pulled downwards, it returns to an upright position, similar to the one shown in FIG. 21.

However, in this Figure, the resilient means have been omitted for the sake of clarity (although in one embodiment they may not be present at all).

To adjust the angle of the torso 14 to the support structure 8 a threaded bolt 188 is provided. It passes through one plate 38 and the end rests against the other plate 36. When the bolt 199 is rotated relative to the plate 38 it moves linearly towards the other plate 36 such that it urges the two plates apart about the hinge 40.

The invention claimed is:

1. A training apparatus including a mannequin, for being struck by a person training for fighting, the apparatus comprising a support structure for supporting the mannequin, the mannequin including a head, a torso, two arms, each having upper and lower arms, and two legs, and having joints at the shoulders, hips, knees and elbows, wherein the joints at the shoulders are configured to variably adjust and fix the position of the upper arms relative to the torso in at least two orthogonal planes, and the joints at the elbows are configured to variably adjust and fix the position of the lower arms relative to the upper arms in at least one plane, the apparatus including ankle attachments for removably attaching the ankles to the support structure, wherein the legs comprise upper and lower legs, and each hip joint includes a resilient member to permit each upper leg to rotate relative to the torso, from an initial position, about all of three axes, upon application of a force, the axes being orthogonal to each other, the resilient member being arranged to enable each upper leg to automatically return to its initial position after the removal of the force.

2. The training apparatus of claim 1, wherein any of the joints include releasable tightening members for varying the tightness of the joints.

3. The training apparatus of claim 1, wherein the joints at the hips are configured to variably adjust and fix the position of the upper legs relative to the torso.

4. The training apparatus of claim 1, wherein the joints at the knees are configured to variably adjust and fix the position of the lower legs relative to the upper legs.

5. The training apparatus of claim 4, wherein the knee joints include rotation limiters to prevent the angle behind the knees, between the upper and lower legs, being greater than or equal to 180 degrees.

6. The training apparatus of claim 1, wherein any one or more of the joints comprises two parts held together by a bolt, each part rotatable relative to the other part about the long axis of the bolt, the bolt including a nut, the tightening of the nut tightening the joint so that the ease with which the two parts rotate relative to one another is decreased, and the loosening of the nut loosening the joint so that the ease with which the two parts rotate relative to one another is increased.

7. The training apparatus of claim 1, including a mannequin mounting for removably attaching the mannequin to the support structure, wherein the mounting also includes adjustment controls for variably adjusting and fixing the position of the torso relative to the support structure.

8. The training apparatus of claim 1, wherein the mannequin includes a resilient, force-absorbing covering, the covering including slits and/or removed portions in the vicinity of joints to facilitate the positioning of the various limbs relative to the torso.

9. The training apparatus of claim 1, wherein each ankle attachment includes a resilient member to permit each lower leg to rotate relative to the support structure about any of three axes, the axes being orthogonal to each other.

10. The training apparatus of claim 1, wherein each lower leg includes a telescopic member for adjusting its length.

11. The training apparatus of claim 1, wherein the apparatus includes ankle position adjustment controls for varying and fixing the position of each ankle relative to the support structure.

12. The training apparatus of claim 11, wherein each ankle position adjustment control includes a telescopic member.

13. The training apparatus of claim 1, including a head attachment member for attaching the head to the torso, wherein the attachment member includes a rotational member for adjustably fixing the position of the head relative to the torso in a range of positions about an axis, to mimic the rotation of a human head about its neck.

14. The training apparatus of claim 1, wherein the support structure includes a fixing structure for fixing the support structure to a wall and/or a frame for floor-standing.

15. The training apparatus of claim 14, wherein the support structure is adjustable for adjusting the position of the mannequin relative to the wall and/or the floor, in use.

16. The training apparatus of claim 1, wherein the support structure includes a resilient member for enabling the upper part of the torso to be pulled downwardly and forwardly in use, the resilient member biasing the torso to an approximate upright position.

17. The training apparatus of claim 16, wherein the resilient member is adjustable so that the force required to overcome the resilient member and pull the upper part of the torso downwardly and forwardly is variable.

18. The training apparatus of claim 1, further comprising pressure sensors and/or accelerometers for assessing and/or recording the movement of the mannequin and/or the force of any applied strikes to it.

19. The training apparatus of claim 1, wherein the mannequin is removable from the support structure, the support structure being configured to receive a support arm for enabling a speed ball or a punch bag to be mounted to it in place of the mannequin.

* * * * *